US010570479B2

(12) United States Patent
Mesplont et al.

(10) Patent No.: US 10,570,479 B2
(45) Date of Patent: Feb. 25, 2020

(54) HIGH TENSILE STEEL WIRE

(71) Applicant: NV Bekaert SA, Zwevegem (BE)

(72) Inventors: Christophe Mesplont, Mouvaux (FR); Geert Tempelaere, Gijzelbrechtegem (BE); Wim Van Haver, Aalter (BE); Maarten De Clercq, Vinderhoute (BE)

(73) Assignee: NV BEKAERT SA, Zwevegem (BE)

( * ) Notice: Subject to any disclaimer, the term of this patent is extended or adjusted under 35 U.S.C. 154(b) by 290 days.

(21) Appl. No.: 15/537,998

(22) PCT Filed: Jan. 28, 2016

(86) PCT No.: PCT/EP2016/051765

§ 371 (c)(1),
(2) Date: Jun. 20, 2017

(87) PCT Pub. No.: WO2016/120366

PCT Pub. Date: Aug. 4, 2016

(65) Prior Publication Data

US 2017/0362679 A1 Dec. 21, 2017

(30) Foreign Application Priority Data

Jan. 30, 2015 (EP) ..... 15153145

(51) Int. Cl.
*C22C 38/34* (2006.01)
*C21D 9/52* (2006.01)
(Continued)

(52) U.S. Cl.
CPC ..... *C21D 9/525* (2013.01); *C21D 1/25* (2013.01); *C21D 8/065* (2013.01); *C22C 38/02* (2013.01);
(Continued)

(58) Field of Classification Search
CPC ..... C21D 9/525; C21D 1/25; C21D 8/065; C21D 2211/008; C22C 38/02; C22C 38/04; C22C 38/18; C22C 38/34
(Continued)

(56) References Cited

U.S. PATENT DOCUMENTS 5,922,149 A 7/1999 Mallen Herrero et al.
10,196,705 B2 * 2/2019 Song ..... C22C 38/40
(Continued)

FOREIGN PATENT DOCUMENTS

JP 9-170030 6/1997
WO 2011/151532 12/2011
(Continued)

OTHER PUBLICATIONS

International Search Report dated Apr. 18, 2016 in International (PCT) Application No. PCT/EP2016/051765.

*Primary Examiner* — Patricia L. Hailey
(74) *Attorney, Agent, or Firm* — Wenderoth, Lind & Ponack, L.L.P.

(57) ABSTRACT

An elongated steel element having a non-round cross-section and being in a work-hardened state, said elongated steel element having as steel composition: a carbon content ranging from 0.20 weight percent to 1.00 weight percent, a silicon content ranging from 0.05 weight percent to 2.0 weight percent, a manganese content ranging from 0.40 weight percent to 1.0 weight percent, a chromium content ranging from 0.0 weight percent to 1.0 weight percent, a sulfur and phosphor content being individually limited to 0.025 weight percent, contents of nickel, vanadium, aluminium, molybdenum or cobalt all being individually limited to 0.5 weight percent, the remainder being iron and unavoidable impurities, said steel having martensitic structure that comprises martensitic grains, wherein a fraction of at least 10 volume percent of martensitic grains is oriented.

17 Claims, 5 Drawing Sheets

(51) Int. Cl.

| | |
|---|---|
| ***C21D 8/06*** | (2006.01) |
| ***C21D 1/25*** | (2006.01) |
| ***C22C 38/02*** | (2006.01) |
| ***C22C 38/04*** | (2006.01) |
| ***C22C 38/18*** | (2006.01) |

(52) U.S. Cl.
CPC ..... *C22C 38/04* (2013.01); *C22C 38/18* (2013.01); *C21D 2211/008* (2013.01)

(58) Field of Classification Search
USPC ..... 148/599
See application file for complete search history.

(56) References Cited

U.S. PATENT DOCUMENTS

| | | | | |
|---|---|---|---|---|
| 2004/0238080 | A1* | 12/2004 | Vandeputte | C21D 8/0273<br>148/602 |
| 2010/0026048 | A1* | 2/2010 | Vlot | B32B 15/013<br>296/193.01 |
| 2011/0182765 | A1* | 7/2011 | Giefers | C21D 1/673<br>420/112 |
| 2014/0227546 | A1* | 8/2014 | Mesplont | C21D 8/06<br>428/544 |
| 2016/0237518 | A1* | 8/2016 | Mesplont | C21D 8/06 |

FOREIGN PATENT DOCUMENTS

| | | |
|---|---|---|
| WO | 2013/041541 | 3/2013 |
| WO | 2015/052035 | 4/2015 |

* cited by examiner

HIGH TENSILE STEEL WIRE

TECHNICAL FIELD

The present invention relates to a high-tensile elongated steel element, in particular a high tensile steel wire, to a process for manufacturing a high-tensile elongated steel element and to various uses or applications of such a high-tensile elongated steel element as spring wire and rope wire.

BACKGROUND ART

U.S. Pat. No. 5,922,149 discloses a method for making steel wires and shaped wires used for enforcement of flexible tube. A shaped wire is produced by rolling or drawing steel consisting of 0.05-0.5% C, 0.4-1.5% Mn, 0-2.5% Cr, 0.1-0.6% Si, 0-1% Mo, no more than 0.25% Ni, and no more than 0.02% S and P, and a first heat treatment is performed on the shaped wire, including at least one step of quenching under predetermined conditions to achieve an HRC hardness of at least 32, a predominately martensitic and bainitic steel structure and a small amount of ferrite. The quenching step comprises passing said steel wire through an austenitizing furnace at a temperature that is greater than point Ac3 of the steel. The shaped wire has a breaking point Rm which does not exceed 900 MPa after the thermal treatment.

International patent application No. 2011/151532 discloses a profiled wire of low-alloy carbon steel intended for use as flexible tube component. The steel wire has following composition: carbon between 0.75% and 0.95%, manganese between 0.30% and 0.85%, chromium less than 0.4%, vanadium less than 0.16%, silicon between 0.15% and 1.40. This steel wire is manufactured by first hot rolling elongated element rod in its austenitic domain followed by cooling down to room temperature. The profiled wire is obtained by first subjecting the wire rod to a thermo-mechanical treatment by two consecutive and ordered phases, namely, an isothermal tempering to confer on the wire rod a homogeneous perlitic microstructure, followed by a cold mechanical transformation operation with an overall work hardening rate comprised between 50 and 80% max, to give it its final shape. The obtained profiled wire is then subjected to a heat treatment at a temperature from 410 to 710° C. giving it the desired final mechanical characteristics. In the patent application, the micro-structure to be created by the isothermal tempering is pearlite to make the steel withstand the deformations applied by drawing and/or rolling.

Carbon steels in the cold-shaped raw states that have a ferrite-pearlite structure and considerably high mechanical strength and hardness values are commonly used. It has been found, nevertheless, that increasing mechanical strength beyond certain limits causes such steels to have inadequate ductility, taking into account e.g. the pre-shaping and bending operations that have to be carried out with spring wire, and reinforcement operations that are needed for reinforcement wire. International patent application WO2013041541 has disclosed a specific heat treatment on a steel wire with a particular steel composition. Thus obtained steel wire has a metallurgical structure with certain volume of retained austenite and high elongation at fracture. A lot of efforts have been done on the steel wires to further improve tensile strength and simultaneously have acceptable or desirable ductility.

DISCLOSURE OF INVENTION

It is an object of the present invention to provide an elongated steel element with a high to extremely high tensile strength and acceptable ductility.

It is another object of the present invention to provide a high-tensile steel wire suitable to be used as spring wire or an element for producing a rope.

It is yet another object of the present invention to provide a suitable process to manufacture an elongated steel element, in particular a steel wire, with a high to extremely high tensile strength and acceptable ductility.

The present invention describes an elongated steel element having very high tensile strength and ductility thanks to the oriented martensitic microstructure, and a method to produce such an elongated steel element in a continuous process. Wherein the "elongated steel element" means a steel element having one pronounced dimension, i.e. length, which is significantly larger than the other two dimensions, i.e. width and thickness, or diameter. For instance, the "elongated steel element" is a steel wire which has a length from several meters to several kilometers and a flat shaped cross-section with a width and thickness in the order of millimeter to several tens of millimeters, e.g. from 0.5 mm to 50 mm, from 1 to 20 mm and wherein the width is larger than the thickness. In the content of the present application, "elongated steel element" mainly refers to steel wire including shaped wire and profiled wire, steel bar, steel rod, steel strapping, steel strip, steel rails and any steel members having an elongated shape.

According to a first aspect of the present invention, there is provided an elongated steel element having a non-round cross-section and being in a work-hardened state, said elongated steel element having as steel composition:

- a carbon content ranging from 0.20 weight percent to 1.00 weight percent, e.g. from 0.50 weight percent to 0.75 weight percent, or about 0.60 weight percent,
- a silicon content ranging from 0.05 weight percent to 2.0 weight percent, e.g. from 0.15 weight percent to 1.8 weight percent, or about 0.20 weight percent, or about 1.40 weight percent,
- a manganese content ranging from 0.40 weight percent to 1.0 weight percent, e.g. from 0.50 weight percent to 0.80 weight percent, or about 0.6 weight percent,
- a chromium content ranging from 0.0 weight percent to 1.0 weight percent, e.g. from 0.01 weight percent to 1.0 weight percent, from 0.10 weight percent to 0.90 weight percent, or from 0.50 weight percent to 0.80 weight percent.
- a sulfur and phosphor content being individually limited to 0.025 weight percent, e.g. limited to 0.015 weight percent,
- contents of nickel, vanadium, aluminum, molybdenum or cobalt being individually limited to 0.50 weight percent, e.g. limited to 0.30 weight percent or limited to 0.10 weight percent, the remainder being iron and unavoidable impurities, and wherein the sum of the weight fractions of all the elements in the steel is equal to 100%, said steel having martensitic structure that comprises martensitic grains, wherein a fraction of at least 10 volume percent of martensitic grains is oriented.

It is known that martensitic steel is a polycrystalline material. When the grains of polycrystalline material are randomly oriented, the polycrystalline material is not oriented or non-textured. Under specific conditions, the grains of polycrystalline material can be preferably oriented, and in this case the polycrystalline material is called to be "oriented", "aligned" or "textured". Two types of orientations or alignment are often confronted, i.e. "crystallographic orientation" and "microstructural orientation". Crystallographic orientation means grains are crystallographically oriented, such as with preferred alignment or orientation of certain crystallographic planes or crystallographic directions. Preferred crystallographic orientation is usually determined from an analysis of the orientation dependence of the diffraction peak intensities (such as by X-Ray Diffraction (XRD) analysis or Electron Backscatter Diffraction (EBSD)) that have been measured in different spatial directions within the coordinate system of the sample. On the other hand, if the grains of polycrystalline material have morphologically anisotropic shape, the grains can also have "microstructural orientation" by such as uniaxial compression during formation of the polycrystalline. "Microstructural orientation" implies that the anisotropic shaped grains are morphologically oriented in preferred directions or planes. This can be detected by image analysis such as scanning electron microscope (SEM). Moreover, crystallographic orientation is often linked with microstructural orientation since the shape anisotropy of grains is often related to their crystallography.

Martensite occurs as lath- or plate-shaped crystal grains. When viewed in cross section, the lenticular (lens-shaped) crystal grains are sometimes described as acicular (needle-shaped). According to the present application, in the produced martensitic steel wire, a fraction of at least 10 volume percent of martensitic grains is oriented. The term "oriented" means that the lenticular grains are either crystallographically oriented or microstructurally oriented, or oriented both crystallographically and microstructurally.

The volume percentage of the crystallographical orientation can be obtained by means of X-Ray Diffraction (XRD) analysis or Electron Backscatter Diffraction (EBSD). The volume percentage of the microstructural orientation can be evaluated by image analysis.

Herein, the term "oriented" does not only mean that the crystallographic axis or the axis of lenticular grains are exactly oriented at the same direction as illustrated by $a_1$ and $a_2$ in FIG. 1, but also refer to the orientation within a tolerance. When the directions of certain axes of grains (or certain crystallographic directions) are deviated, as presented by angle $\alpha$ in FIG. 1, within 20°, preferably within 10°, more preferably within 5°, these grains are also considered as oriented.

The orientation at least refers to one dimensional preferred orientation, e.g. in the direction perpendicular to the plane of lenticular grains (direction as shown by $a_1$, $a_2$, e.g. [001], in FIG. 1). For one dimensional orientation, the lenticular grains are randomly distributed in the directions on the lenticular plane (directions as shown by $a_4$, $a_5$, in FIG. 1). The orientation may also refer to three dimensional preferred orientation, i.e. the grains are preferably orientated in two orthogonal directions, e.g. [001] and [100].

The invention elongated steel element can be in a work-hardened state, which means that the elongated steel element is work hardened by means of a mechanical transformation such as wire drawing or rolling. Wire drawing is a metal working process used to reduce the cross-section of a wire by pulling the wire through a single, or series of, drawing die(s). Wire rolling is a process of reduction of the cross-section area or shaping a metal piece through the deformation caused by a pair of rotating in opposite directions metal rolls. It is known that work-hardening increases the tensile strength Rm and decreases ductility of the wire. The ductility of the wire can be reflected by the elongation at fracture At. As will be illustrated hereinafter, in comparison with traditional steel wires, the invention steel wire with specific composition only needs a few reductions steps to reach comparative levels of tensile strength with the high level of elongation.

According to the present invention, the elongated steel element has additional advantage when its cross-section is non-round. The martensitic grains of the steel according to the present invention are oriented and the orientation is normally linked with the production of the elongated steel elements. The orientation of the martensitic grains or the texture of the product has consequently certain relationship with the geometry or dimension of the product. For instance, due to the specific directional compacting force, the texture of a cold rolled flat shaped wire is better compared with a drawn wire having round cross-section. Moreover, the orientation direction of the martensitic grains of a cold rolled flat shaped wire relative to the geometry of the product can be recognized from the anisotropy of the non-round cross-section.

Preferably, a fraction of at least 20 volume percent of martensitic grains is oriented. More preferably, a fraction of at least 30 volume percent of martensitic grains is oriented. Most preferably, a fraction of at least 40 volume percent of martensitic grains is oriented.

The elongated steel element according to the present application preferably has a yield strength $Rp_{0.2}$ which is at least 80 percent of the tensile strength Rm. $Rp_{0.2}$ is the yield strength at 0.2% permanent elongation. More preferably, the yield to tensile ratio, i.e. $Rp_{0.2}/Rm$, is between 80 percent and 96 percent. Therefore, the steel wire after elastic deformation can be still deformed to certain extent before breaking. However, as will be cited further, consecutive heat treatment can result in a very high yield to tensile ratio (with Rm before the heat treatment being higher than or equal to Rm following the heat treatment) in combination with elongation at fracture $A_t$ higher than 3%.

The elongated steel element according to the present application preferably has a corrosion resistance coating. More preferably, the steel wire has a corrosion resistance coating selected from any one of zinc, aluminium, nickel, silver, copper, or their alloys. In such a case, the wires have a prolonged life time even in a harsh corrosive environment.

Without consecutive heat treatment, the elongated steel element can have a tensile strength Rm of at least 1200 MPa and an elongation at fracture $A_t$ of at least 3 percent. The elongated steel element can be in a cold-rolled state. The elongated steel element can be a flat shaped wire and therefore has a "blacksmith cross" at cross-section. Without consecutive heat treatment, the flat shaped steel wire has a tensile strength Rm of at least 1200 MPa for cross-section area below 300 $mm^2$ and at least 1300 MPa for cross-section area below 100 $mm^2$ and at least 1400 MPa for cross-section area below 5 $mm^2$. Preferably Rm can be tunable down to 1000 MPa with a consecutive heat treatment. With a consecutive heat treatment, the tensile strength Rm can be tuned, depending on time and temperature of the thermal cycle, between the Rm obtained prior to the heat treatment and down to 1000 MPa.

According to a second aspect of the present invention, the elongated steel element may be used as spring wire or an element for producing a rope.

According to a third aspect of the present invention, there is provided a process of manufacturing an elongated steel element, said elongated steel element having a non-round cross-section and being in a work-hardened state, said elongated steel element having as steel composition:

- a carbon content ranging from 0.20 weight percent to 1.00 weight percent, e.g. from 0.50 weight percent to 0.75 weight percent, or about 0.60 weight percent,
- a silicon content ranging from 0.05 weight percent to 2.0 weight percent, e.g. from 0.15 weight percent to 1.8 weight percent, or about 0.20 weight percent, or about 1.40 weight percent,
- a manganese content ranging from 0.40 weight percent to 1.0 weight percent, e.g. from 0.50 weight percent to 0.80 weight percent, or about 0.6 weight percent,
- a chromium content ranging from 0.0 weight percent to 1.0 weight percent, e.g. from 0.01 weight percent to 1.0 weight percent, from 0.10 weight percent to 0.90 weight percent, or from 0.50 weight percent to 0.80 weight percent.
- a sulfur and phosphor content being individually limited to 0.025 weight percent, e.g. limited to 0.015 weight percent,
- contents of nickel, vanadium, aluminum, molybdenum or cobalt being individually limited to 0.50 weight percent, e.g. limited to 0.30 weight percent or limited to 0.10 weight percent, the remainder being iron and unavoidable impurities, and wherein the sum of the weight fractions of all the elements in the steel is equal to 100%, said steel having martensitic structure that comprises martensitic grains, wherein a fraction of at least 10 volume percent of martensitic grains is oriented.

said process comprising the following steps in order:

a) austenitizing a steel ingot, a steel wire rod or a steel (drawn or rolled) wire above Ac3 temperature during a period less than 120 seconds, b) quenching said austenitized steel ingot, steel wire rod or steel wire below 100° C. during a period less than 60 seconds, c) tempering said quenched steel ingot, steel wire rod or steel wire between 320° C. and 700° C. during a period ranging from 10 seconds to 600 seconds, d) work hardening said quenched and tempered steel ingot, steel wire rod or steel wire into an elongated steel element.

In the prior art, such as in the disclosure of U.S. Pat. No. 5,922,149, the steel wire or wire rod was first deformed or work hardened to final dimension and thereafter quenched and tempered, as schematically shown in FIG. 2. In contradiction, according to the present invention, the steel ingot, steel wire rod or steel wire is first quenched below the temperature at which martensite formation ends, in a short time resulting in a martensitic structure. In this martensitic structure there is almost no or very limited, e.g. less than 1 vol %, austenite retained. Tempering the quenched steel wire rod or steel wire is followed thereafter. The tempered martensitic steel is then deformed or work hardened, e.g. by drawing or rolling, into final dimension, as schematically shown in FIG. 3. The orientation of martensitic grains is a result of applied compression force via drawing or rolling on the quenched and tempered martensitic elongated steel elements. The degree of orientation mainly depends on the applied compression force and strain hardening.

Present invention receives unexpected technical results and advantages. Usually in wire processing quenching and tempering is the final step, and martensite has always been claimed as detrimental for drawing or rolling. The tensile strength of the martensitic wire according to the present invention is very high and the combination of the level of tensile strength with the high level of ductility is uncommon. The surprising result obtained by drawing or rolling the tempered martensitic steel may be attributed to the special alloying of the steel (microalloyed with Cr and Si) versus conventional eutectoid steels. The orientation of martensitic grains in the cold-deformed elongated steel element is the result of applied compression force via deformation on the quenched and tempered martensitic steel. The synergy effect of the composition and the process of the present application results in a martensitic elongated steel element having a preferred martensitic orientation.

The process may further comprise a step of e) aging said work hardened elongated steel element at a temperature between 100° C. and 250° C.

Preferably, in the process said work hardening occurs at a temperature below 700° C. According to a preferred embodiment, said work hardening is cold rolling. Cold deformation has an added effect of work hardening and strengthening the material, and thus further improves the material's mechanical properties. It also improves the surface finish and holds tighter tolerances allowing desirable qualities that cannot be obtained by hot deformation. Alternatively, according to another possible embodiment, said work hardening is warm rolling occurring between 400° C. and 700° C. For a similar reduction, the application of warm rolling significantly reduces the amount of required passes, the load on the rolls and simplifies the process.

The process may further comprise the alternative step of e) annealing said work hardened elongated steel element at a temperature between 350° C. and 700° C. The annealing step can remove residual stresses, increase the yield to tensile ratio and further improve the ductility of the elongated steel elements.

BRIEF DESCRIPTION OF FIGURES IN THE DRAWINGS

The invention will be better understood with reference to the detailed description when considered in conjunction with the non-limiting examples and the accompanying drawings, in which:

FIG. 1 schematically shows grain orientation in polycrystallographical materials.

FIG. 7 (*b*) shows the scanning electron microstructure at the short edge of the cross-section of the flat shaped steel wire.

FIG. 7 (*c*) shows the scanning electron microstructure at the long edge of the cross-section of the flat shaped steel wire.

FIG. 9 (*b*) shows the scanning electron microstructure at the edge of the wire rod.

MODE(S) FOR CARRYING OUT THE INVENTION

Figure 1:
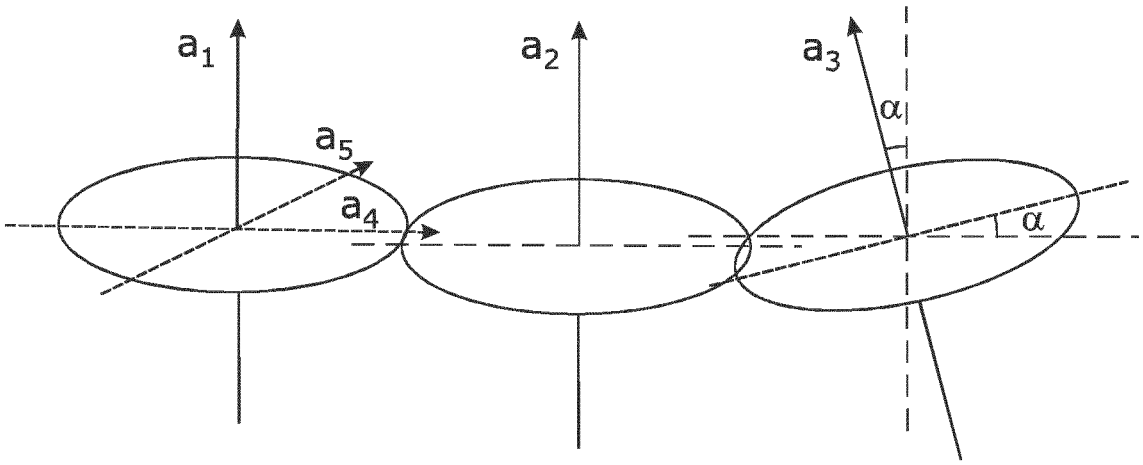
Figure 2:
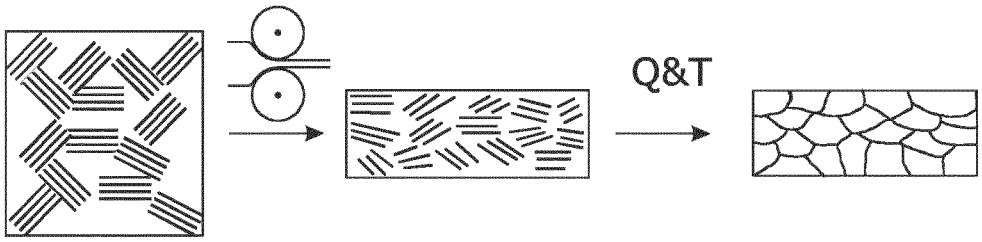
FIG. 2 illustrates a thermo-mechanical process for steel wires according to the prior art.
Figure 3:
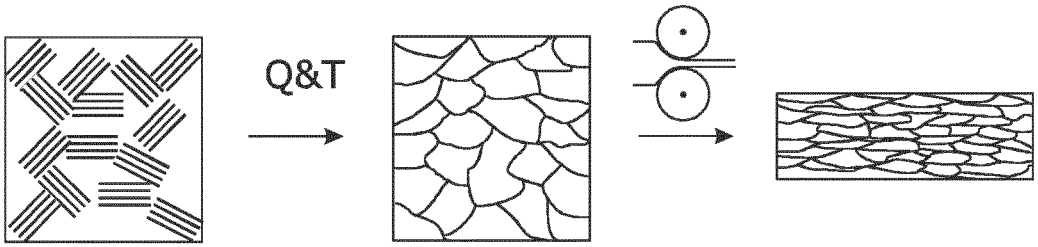
FIG. 3 illustrates the thermo-mechanical process for steel wires according to the present invention.
Figure 4:
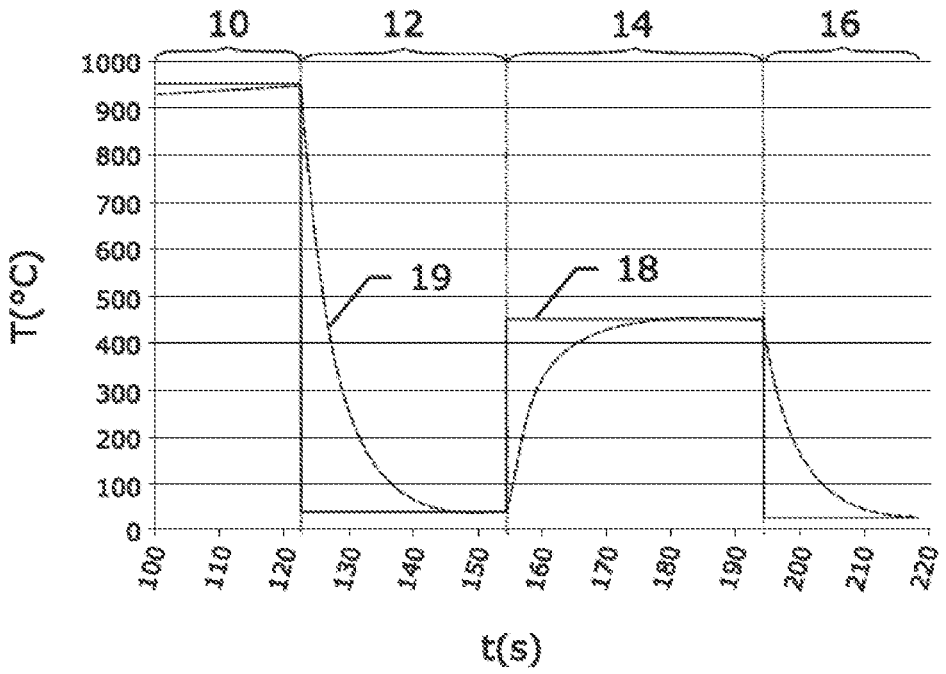
FIG. 4 illustrates a temperature versus time curve for a thermal process according to the present invention.

FIG. 4 illustrates a suitable temperature versus time curve applied to a steel wire or wire rod with a diameter of 6.5 mm and with following steel composition:

% wt C=0.55
% wt Mn=0.65
% wt Si=1.4
% wt Cr=0.6 the balance being iron and unavoidable impurities.

The starting temperature of martensite transformation Ms of this steel is about 280° C. and the temperature Mf, at which martensite formation ends is about 100° C.

The various steps of the process are as follows:

- a first austenitizing step (10) during which the steel wire stays in a furnace at about 950° C. during 120 seconds,
- a second quenching step (12) for martensite transformation in oil at a temperature below 100° C. during at least 20 seconds;
- a third tempering step (14) for increase the toughness at a temperature about 450° C. during less than 60 seconds; and
- a fourth cooling step (16) at room temperature during 20 or more seconds.

Curve 18 is the temperature curve in the various equipment parts (furnace, bath . . . ) and curve 19 is the temperature of the steel wire or wire rod.

The steel wire or wire rod after above thermal treatment has a tempered martensitic microstructure.

The formed martensitic steel wire or wire rod is continued with cold rolling, i.e. below 400° C., to flat shape. The steel element is cold rolled to final dimension through several rolling stands. The more rolling stands the steel wire pass, the more thickness reduction. The tension of the steel wire may be measured and controlled. It is important to minimize or eliminate the tension in the steel wire moving between stands. Tension can result in a substantial narrowing of the steel. A precision speed regulation system can be used to control the speed at which the rollers are driven to minimize tension. As an example, an edge rolling is inserted between two thicknesses rolling.

Figure 5:
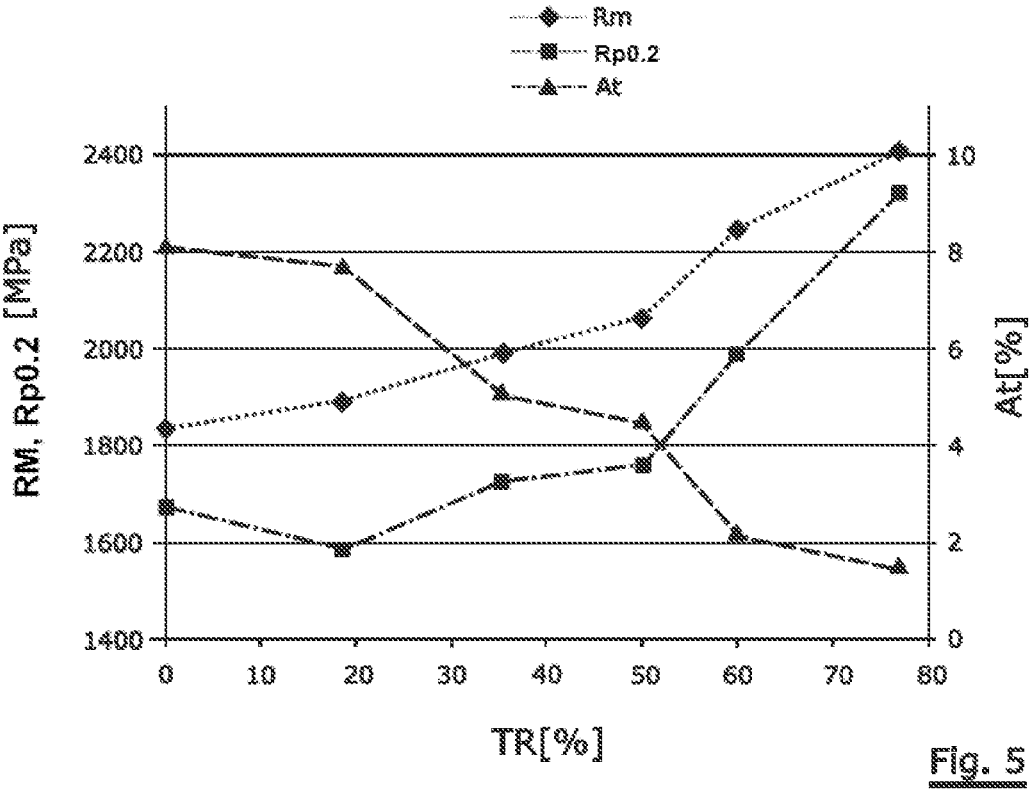
FIG. 5 shows the tensile/yield strength, and elongation as a function of thickness reduction according to the second embodiment of the present invention.

The yield ($R_p0.2$) and tensile (Rm) strength at different level of thickness reduction together with the elongation at fracture At are shown in FIG. 5. As shown in FIG. 5, both the tensile and yield strength increase with the thickness reduction. The yield to tensile ratio is between 80 and 96. Having a thickness reduction of 60%, the tensile strength of the flat shaped steel wire can go up to 2200 MPa without failure or breaking. Such a flat shaped steel wire has an elongation at fracture At about 2%, which is acceptable for further processing or operations such as bending.

This very high tensile strength is a consequence of oriented martensitic grains in the steel wire after rolling. The orientation was analyzed by image analysis and it appears a fraction of at least 10 volume percent of martensitic grains is oriented.

Figure 6:
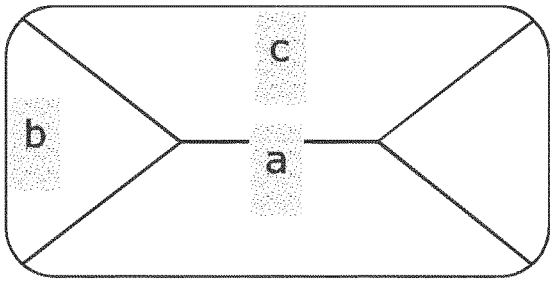
FIG. 6 is a schematic view of "blacksmith-cross" on the cross-section of flat shaped elongated steel elements produced according the present invention.
Figure 7A:
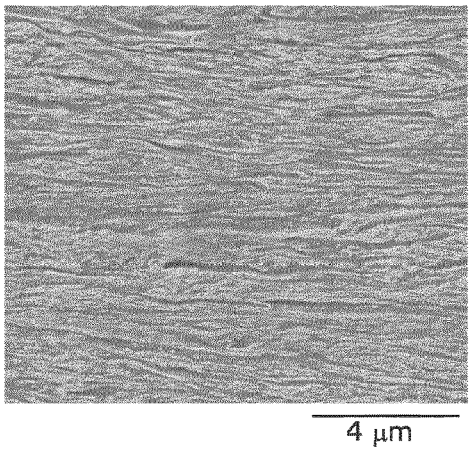
FIG. 7 (*a*) shows the scanning electron microstructure (SEM) near the center of the "blacksmith-cross" of flat shaped steel wire.
Figure 7B:
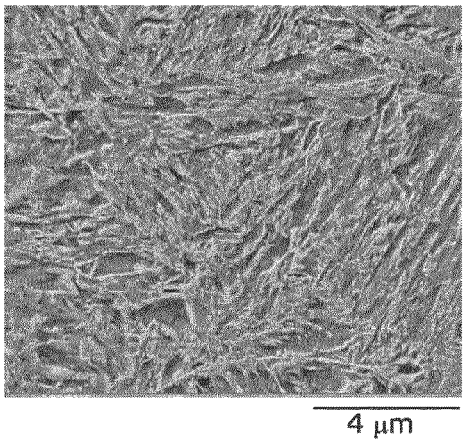
Figure 7C:
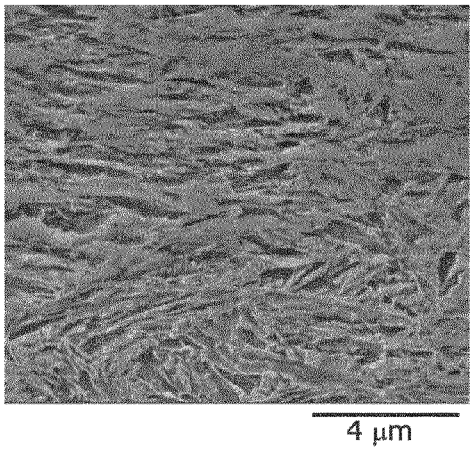

In particular, the martensitic grains are well oriented near the so called "blacksmith cross" (as shown in FIG. 6) characterized by a maximal strain area created due to rolling. In some instance, it is also called "lamination cross" since it is a formation of macroscopic shear bands. In terms of stresses, rolling has a heterogeneous repartition of stress components between the center, the long edge and the short edge of the flat shaped wire. The highest strains or strongest deformation takes place at a cross area as schematically shown in FIG. 6. The strain distribution determines the orientation of lenticular shaped martensitic grains such that the martensites are much better compressed and consequently oriented near this cross area (e.g. position indicated by (a) in FIG. 6) in comparison with the orientation near the short and long edges (positions indicated respectively by (b) and (c) in the cross-section view of FIG. 6). FIG. 7(*a*) and FIGS. 7(*b*)&(*c*) shows respectively the microstructures of the cross-section near the center (indicated by (a) in FIG. 6) and near the short and long edges of the flat shaped wire (indicated respectively by (b) and (c) in FIG. 6) cold-rolled to 11.9 mm in width and 3.5 mm in thickness. As shown in FIG. 7(*a*), the lenticular shaped martensitic grains appear needlelike shape microstructure and are well oriented. It has been found in particular near the center of the cross-section the axes of lenticular (lens-shaped) martensitic crystal grains are oriented substantially normal to the long edge of the flat shaped wire. The degree of orientation of martensitic grains at the edges as shown in FIGS. 7(*b*) &(*c*) are not as high as that shown in FIG. 7(*a*) which is near the center.

Figure 8:
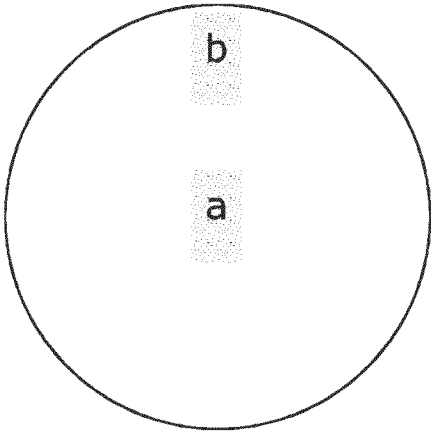
FIG. 8 is a schematic view of the cross-section of a wire rod after a same thermal treatment according to the present invention.
Figure 9A:
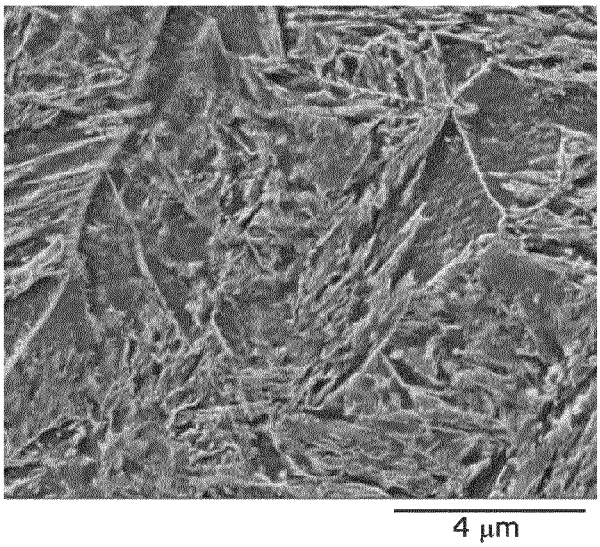
FIG. 9 (*a*) shows the scanning electron microstructure near the center of the wire rod.
Figure 9B:
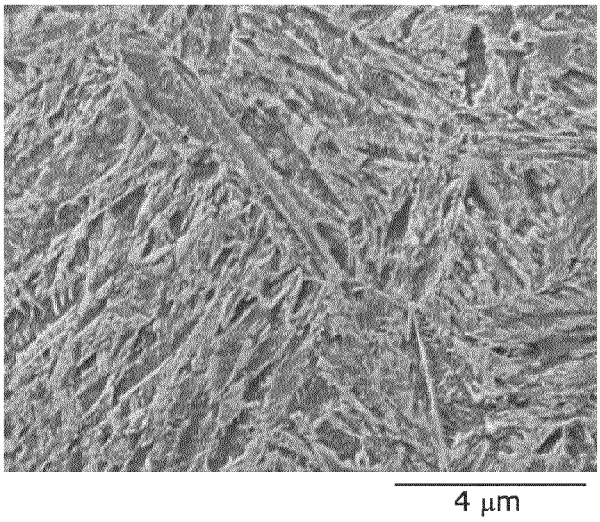

As a comparison, the microstructure at the edge (indicated by position (b) in FIG. 8) and near the center (indicated by position (a) in FIG. 8) of a wire rod with a round cross-section (FIG. 8) is also observed and shown in FIG. 9. The wire rod went through a same thermal treatment as the flat shaped wire of the invention, and there is no cold deformation applied to this wire rod during or after the thermal treatment. Without cold deformation, the wire rod appears a homogeneous microstructure. The martensitic grains are randomly oriented either near the center (FIG. 9(*a*)) or at the edge (FIG. 9(*b*)) of the wire rod.

Figure 10:
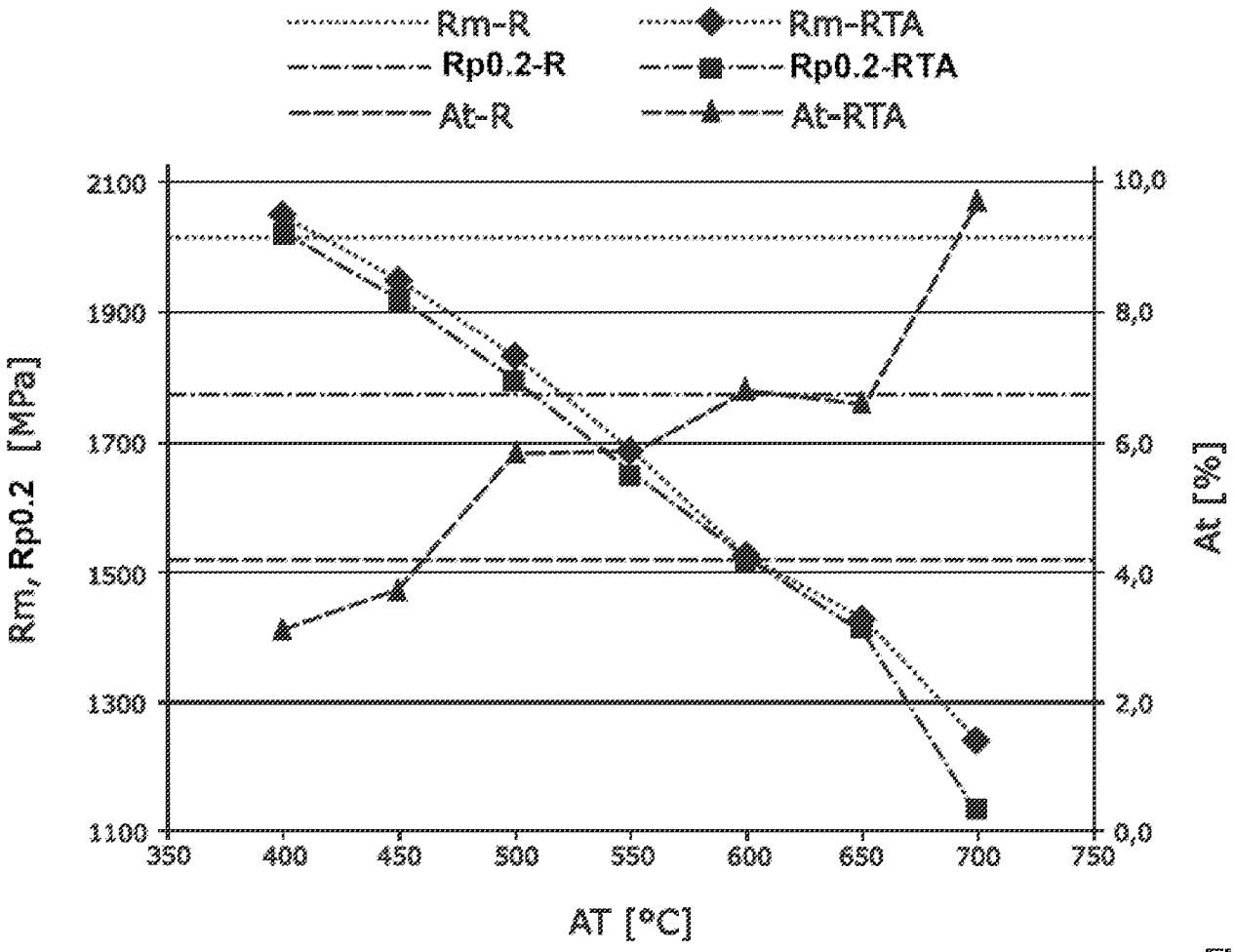
FIG. 10 shows the development of tensile/yield strength, and elongation of the steel wire according to the present invention as a function of annealing temperature.

As an additional and optional step, an anneal treatment may be used after rolling to remove stresses. The initial cold-rolled flat shaped wire has a tensile strength of about 2020 MPa, yield strength of about 1750 MPa and an elongation at fracture of about 4.2%. The work hardened steel wires continuously pass at a speed of 15 m/min through an annealing furnace or oven at a temperature between 350° C. and 750° C. The development of tensile strength (Rm-R), yield strength (Rp0.2-R) and elongation at fracture (At-R) of the steel wire as a function of the annealing temperature (AT) are shown in FIG. 10. When the wire was annealed at low temperature, i.e. about 400° C. or 450° C., the elongation was not improved and even slightly decreased. However, when annealed at a temperature above 500° C., the elongation at fracture (At-RTA) of work hardened steel wire increases with annealing temperature as shown in FIG. 10. When the steel wire was annealed at 700° C., the elongation at fracture (At-RTA) of steel wire can go up to about 9.5%. Both the tensile strength (Rm-RTA) and the yield strength (Rp0.2-RTA) decrease with the annealing temperature of the steel wire.

As an example, the work hardened steel wire is annealed so as to reduce its tensile strength Rm from about 2020 MPa to a value comprised between 1000 MPa and 1500 MPa, preferably comprised between 1200 MPa and 1500 MPa. As another example, the work hardened steel wire is annealed so as to reduce its tensile strength Rm from about 2020 MPa to a value comprised between 1500 MPa and 1900 MPa, preferably comprised between 1600 MPa and 1800 MPa.

The annealing treatment on the one hand significantly influences the strength and the elongation of the wire, and on the other hand can also be controlled to improve fatigue resistance, corrosion resistance and resistance to hydrogen embrittlement.

According to the present invention, alternatively, warm rolling is used to flatten or reduce the thickness of the steel wire. The quenched and tempered round or flat wire is first warmed up to a temperature between 400° C. and 700° C. in a furnace or oven before the warm rolling, preferably in a median frequency induction heating furnace. Here, median frequency means a frequency in the range of 10 to 200 kHz. Preferably, a trimming unit is used during warm rolling that adjusts the temperature of the steel to compensate for heat loss that may occur during the rolling step.

The invention claimed is:

1. An elongated steel element having a non-round cross-section and being in a work-hardened state, said elongated steel element having as steel composition:

- a carbon content ranging from 0.20 weight percent to 1.00 weight percent,
- a silicon content ranging from 0.05 weight percent to 2.0 weight percent,
- a manganese content ranging from 0.40 weight percent to 1.0 weight percent,
- a chromium content ranging from 0.0 weight percent to 1.0 weight percent,
- a sulfur and phosphor content being individually limited to 0.025 weight percent,
- contents of nickel, vanadium, aluminium, molybdenum or cobalt being individually limited to 0.5 weight percent,
- the remainder being iron and unavoidable impurities, said steel having martensitic structure that comprises martensitic grains and less than 1 vol % retained austenite, wherein a fraction of at least 10 volume percent of martensitic grains is oriented.

2. An elongated steel element according to claim 1, wherein a fraction of at least 20 volume percent of martensitic grains is oriented.

3. An elongated steel element according to claim 1, wherein a fraction of at least 40 volume percent of martensitic grains is oriented.

4. An elongated steel element according to claim 1, said elongated steel element having a yield strength Rp0.2 which is at least 80 percent of the tensile strength Rm.

5. An elongated steel element according to claim 1, said elongated steel element having a tensile strength Rm of at least 1200 MPa and an elongation at fracture At of at least 3 percent.

6. An elongated steel element according to claim 1, said elongated steel element having a tensile strength Rm of at least 1200 MPa for cross-section area below 300 $mm^2$ and at least 1300 MPa for cross-section area below 100 $mm^2$ and at least 1400 MPa for cross-section area below 5 $mm^2$.

7. An elongated steel element according to claim 1, said elongated steel element being in a cold-rolled state.

8. An elongated steel element according to claim 1, said elongated steel element being in a warm-rolled state.

9. An elongated steel element according to claim 1, said elongated steel element is a flat shaped wire.

10. An elongated steel element according to claim 9, wherein said flat shaped wire has a "blacksmith cross" visible on its cross-section.

11. A spring wire or an element for producing a rope comprising an elongated steel element according to claim 1.

12. A process of manufacturing an elongated steel element, said elongated steel element having a non-round cross-section and being in a work-hardened state, said elongated steel element having as steel composition:

- a carbon content ranging from 0.20 weight percent to 1.00 weight percent,
- a silicon content ranging from 0.05 weight percent to 2.0 weight percent,
- a manganese content ranging from 0.40 weight percent to 1.0 weight percent,
- a chromium content ranging from 0.0 weight percent to 1.0 weight percent,
- a sulfur and phosphor content being individually limited to 0.025 weight percent,
- contents of nickel, vanadium, aluminium, molybdenum or cobalt being individually limited to 0.5 weight percent,
- the remainder being iron and unavoidable impurities, said steel having martensitic structure that comprises martensitic grains and less than 1 vol % retained austenite, wherein a fraction of at least 10 volume percent of martensitic grains is oriented, said process comprising the following steps in order:

a) austenitizing a steel ingot, a steel wire rod or a steel (drawn or rolled) wire above Ac3 temperature during a period less than 120 seconds, b) quenching said austenitized steel ingot, steel wire rod or steel wire below 100° C. during a period less than 60 seconds, c) tempering said quenched steel ingot, steel wire rod or steel wire between 320° C. and 700° C. during a period ranging from 10 seconds to 600 seconds, d) work hardening said quenched and tempered steel ingot, steel wire rod or steel wire into an elongated steel element.

13. A process according to claim 12, said process further comprising the step of e) annealing said work hardened elongated steel element at a temperature between 350° C. and 700° C.

14. A process according to claim 13, wherein said work hardening is cold rolling.

15. A process according to claim 13, wherein said work hardening is warm rolling occurring between 400° C. and 700° C.

16. A process according to claim 12, wherein said work hardening is cold rolling.

17. A process according to claim 12, wherein said work hardening is warm rolling occurring between 400° C. and 700° C.

* * * * *